US006866645B2

(12) United States Patent
Lee

(10) Patent No.: US 6,866,645 B2
(45) Date of Patent: Mar. 15, 2005

(54) PLEASURE PROMOTIVE SEXUAL DRIVE

(76) Inventor: Shuei-Yuan Lee, 7F, No. 100, Sing-Sheng N. Rd., Sec. 2, Taipei (TW)

( * ) Notice: Subject to any disclaimer, the term of this patent is extended or adjusted under 35 U.S.C. 154(b) by 240 days.

(21) Appl. No.: 10/349,970

(22) Filed: Jan. 24, 2003

(65) Prior Publication Data

US 2004/0147858 A1 Jul. 29, 2004

(51) Int. Cl.[7] ..... A61H 21/00

(52) U.S. Cl. ..... 601/101; 601/93; 601/97; 600/38

(58) Field of Search ..... 601/46, 51, 70, 601/89, 90, 92, 93, 97, 98, 99, 101, 107, 108, 111, 136; 600/38, 39, 40, 41; 606/238, 239; 128/845

(56) References Cited

U.S. PATENT DOCUMENTS 4,722,327 A * 2/1988 Harvey ..... 601/97
4,790,296 A * 12/1988 Segal ..... 601/97
5,076,261 A * 12/1991 Black ..... 601/93
5,676,637 A * 10/1997 Lee ..... 601/134
6,142,929 A * 11/2000 Padgett ..... 600/38
6,422,993 B1 * 7/2002 Hudson ..... 600/38
6,632,185 B2 * 10/2003 Chen ..... 601/101

* cited by examiner

*Primary Examiner*—Justine R. Yu
*Assistant Examiner*—Quang D. Thanh
(74) *Attorney, Agent, or Firm*—Bacon & Thomas PLLC

(57) ABSTRACT

The pleasure promotive sexual device includes a mechanism assembly composed mechanical devices including a motor. When the motor is activated, an extension shaft in the mechanism assembly is interlocked for impelling a dildo provided at the front end thereof and for further automatic mechanical movements of stretching and contracting back and forth, and pleasure of a certain extent is achieved for the wife followed by that provided by the husband. Therefore both the husband and wife are able to easily come to orgasms, thus relatively flavoring lives of and building happy families married couples.

4 Claims, 3 Drawing Sheets

PLEASURE PROMOTIVE SEXUAL DRIVE

BACKGROUND OF THE INVENTION (a) Field of the Invention

The invention relates to a pleasure promotive sexual device capable of flavoring lives of and building happy families for married couples, thereby making the community more peaceful and harmonious.

(b) Description of the Related Art

During sexual activities, females are more unliable to orgasms because of their physical characteristics and degrees of coordination from their partners.

To spice up lives of or build happy families for married couples, the invention provides a pleasure promotive sexual device. During sexual activities, automatic thrusting movements provided by the sexual device in accordance with the invention are utilized such that a certain level of pleasure is achieved for the wife first, followed by that provided by the husband. Through this method, both the husband and wife may easily come to orgasms, thus relatively flavoring lives of and building happy families married couples.

SUMMARY OF THE INVENTION

An object of the invention is to provide a pleasure promotive sexual device, wherein a turnable thereof is impelled by a motor axis thereof, automatic mechanical movements of stretching and contracting back and forth are provided by an interlocking shaft and an extension shaft thereof, and the speed of a decelerating mechanism at a motor controlled by a fine tuning switch at a control compartment is used for impelling a dildo disposed at the front end of the extension shaft, thereby promoting pleasures during sexual activities for married couples.

DESCRIPTION OF THE PREFERRED EMBODIMENTS

Figure 1:
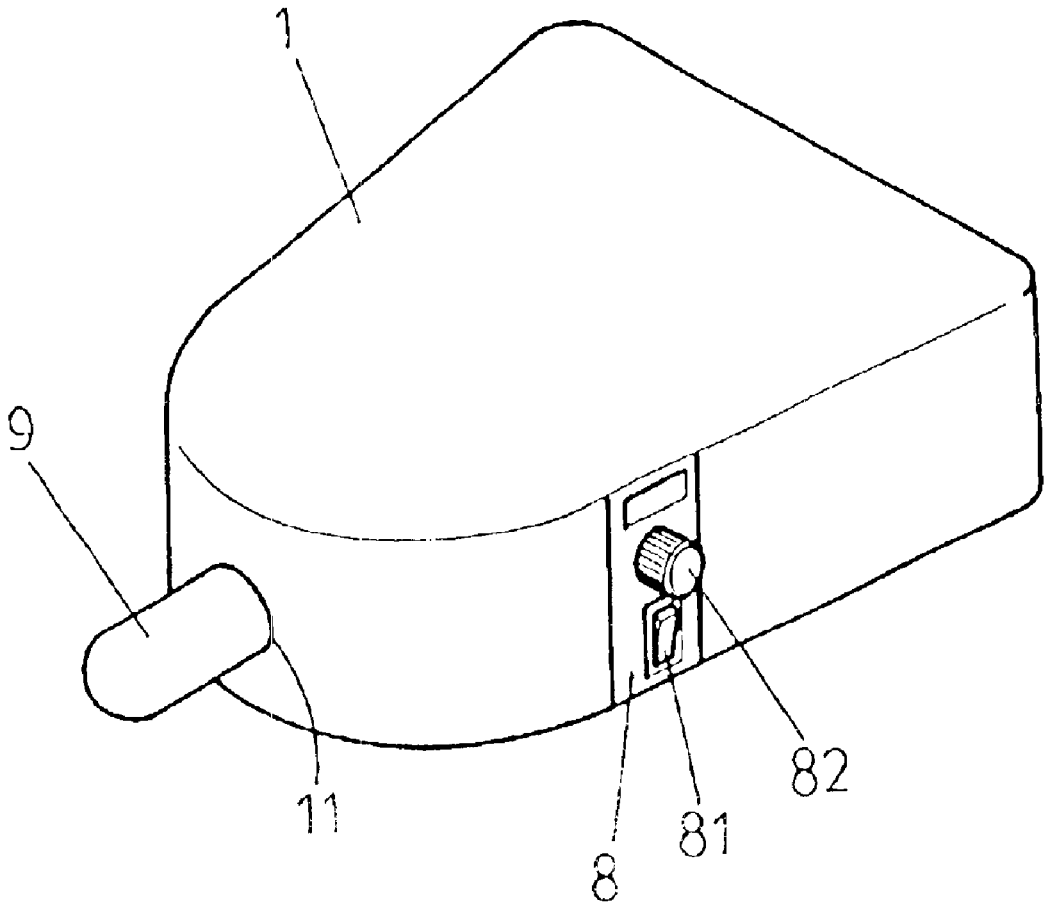
FIG. 1 is a schematic view showing the appearance according to the invention.

Referring to the accompanying drawings, the device in accordance with the invention comprises a shell 1, a motor 2, a decelerator mechanism 3, a turnable 4, an interlocking shaft 5, a connection shaft 6, an extension shaft 7, and a control compartment 8. Wherein, the motor 2, the decelerating mechanism 3, the turnable 4, the interlocking shaft 5, the connection shaft 6 and the extension shaft 7 are disposed in the shell 1, and the control compartment 8 is disposed at one side of the shell 1 and is further provided with a power switch 81 and a fine tuning switch 82 at the shell surface thereof.

Figure 2:
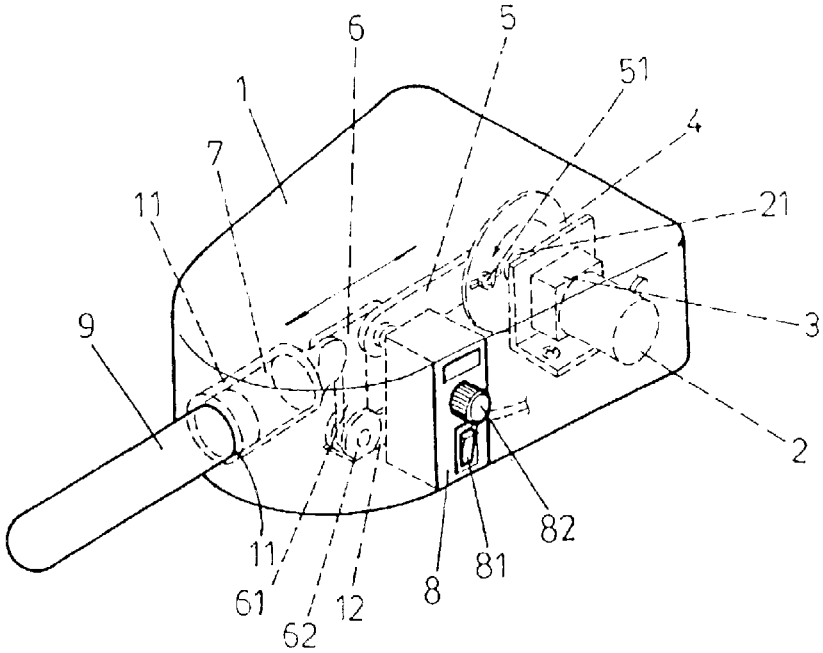
FIG. 2 is a sectional view according to the invention.
Figure 3:
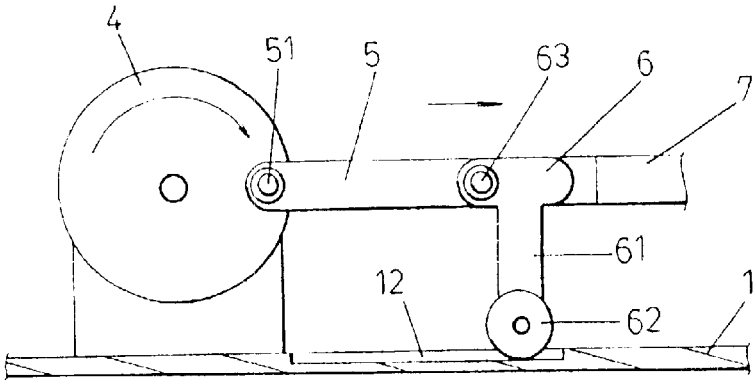
FIG. 3 is a side view showing the movements according to the invention.
Figure 4:
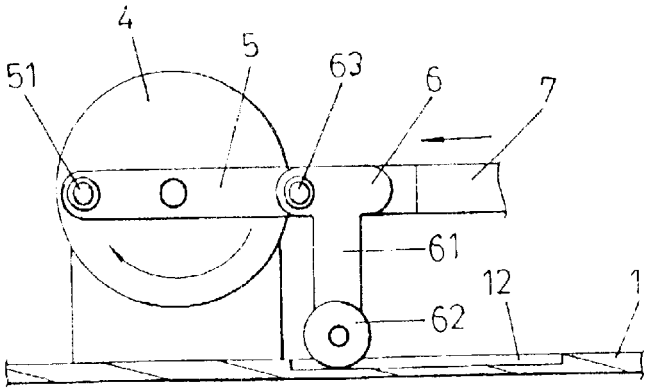
FIG. 4 is another side view showing the movements according to the invention.

A motor axis 21 at one end of the motor 2 is interlocked with the decelerating mechanism 3 further interlocked with one end of the circular turnable 4 for impelling and rotating the turnable 4. One end of the interlocking shaft 5 is secured to the circular turnable 4 by means of a bolt 51, and the turnable 4 is employed for impelling and rotating the bolt 51 at the interlocking shaft 5 for up-and-down and back-and-forth movements because of preliminary back-and-forth movements of the interlocking shaft 5 generated from the rotation of the bolt 51. Referring to FIGS. 3 and 4, the other end of the interlocking shaft 5 is secured to the connection shaft 6 by means of a bolt 63, and below the connection shaft 6 is provided with a secondary shaft 61 further connected with a roller 62, such that the roller 62 is able to slide along a track 12 provided at the bottom of the shell 1. The other end of the connection shaft 6 is connected to the extension shaft 7 by soldering and enables the extension shaft 7 to accomplish horizontal stretching and contracting movements. The extension shaft 7 is disposed in an inner housing 11 of the shell 1 (as shown in FIG. 2) and is capable of moving back and forth within the inner housing (as a storing track) 11 of the shell 1 as impelled by the motor 2.

The fine tuning switch 82 at the control compartment 8 is for controlling the rotational speed of the decelerating mechanism 3 provided at one end of the motor 2 and for further controlling the rotational speed changes of the motor axis 21 of the motor 2, thereby speeding up or slowing down the automatic mechanical movements of stretching and contracting back and forth provided by the extension shaft 7.

Figure 6:
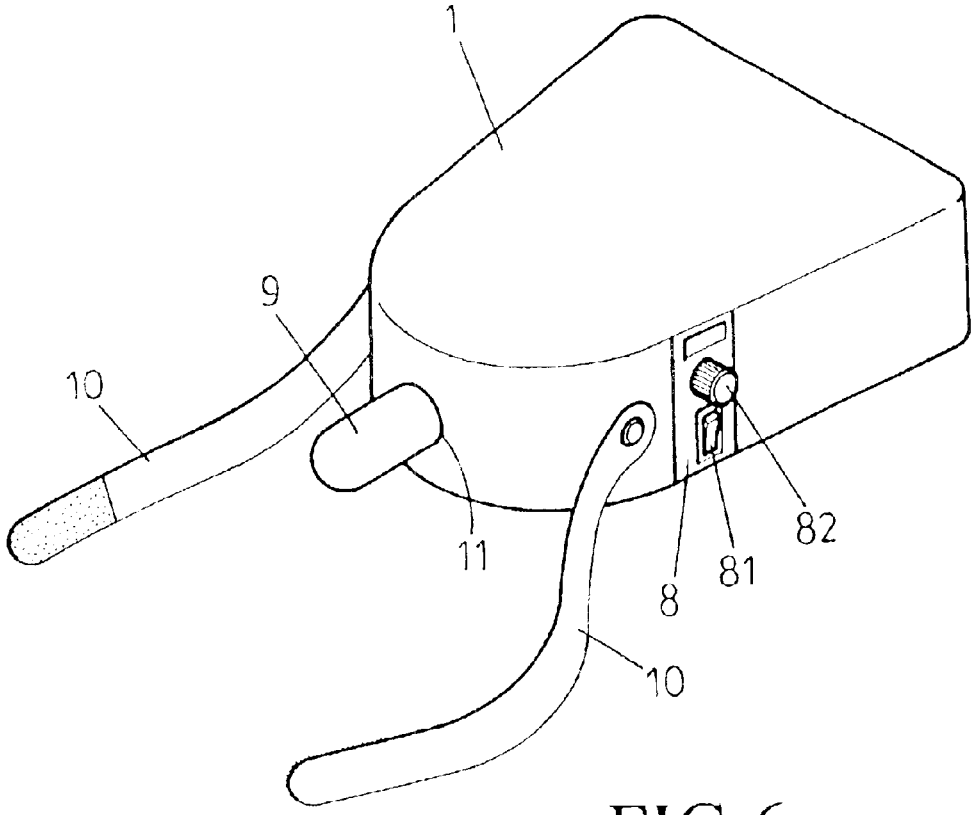
FIG. 6 is a schematic view showing an embodiment according to the invention.
Figure 5:
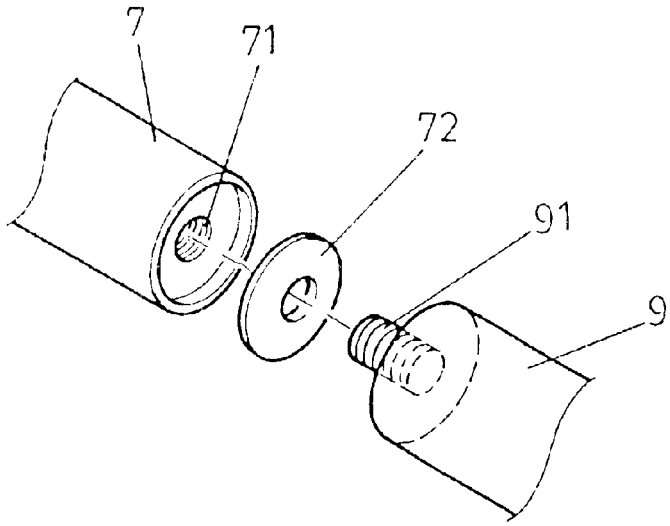
FIG. 5 is a structural view showing the dildo and the extension shaft according to the invention.

Referring to FIG. 5 showing an embodiment in which a dildo 9 is installed, one end of the extension shaft 7 is provided with a screw opening 71 next to which a waterproof washer is disposed. The dildo 9 is replaceable based on shapes and sizes of personal preferences, and a screw pillar 91 disposed at the front rim thereof is for securing into the screw opening 71 of the extension 7. Referring to FIGS. 2 and 6, the dildo 9 is disposed in the inner housing 11 of the shell 1 for stretching and contracting back and forth. In addition, the extension 7 may be varied by adding a screw pillar that coordinates with a screw opening added at the dildo 9 for fastening and combining the dildo 9 onto the extension shaft 7.

Referring to FIG. 6, at the two sides of the shell 1 are secured and provided with a fastening strip 10, respectively, for binding around the inner thighs of a female to prevent the sexual device in accordance with the invention slipping off the female and failing to apply the automatic mechanical movements of stretching and contracting back and forth.

Conclusive from the above, the sexual device in accordance with the invention is an innovation that not only spices lives of but also builds happy families for married couples, thereby making the community more peaceful and harmonious. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A pleasure promotive sexual device comprising:

a shell having an inner housing;

a motor accommodated within the shell and has a motor axis extended from one end thereof;

a decelerating mechanism accommodated within the shell and is connected to the motor;

a turnable accommodated within the shell and is interlocked with the decelerating mechanism capable of impelling and rotating the turnable;

an interlocking shaft accommodated within the shell and has one end thereof secured to the turnable;

a connection shaft accommodated within the shell and has one end thereof connected to the interlocking shaft; wherein below the connection shaft is provided with a secondary shaft connected to a roller, and the roller is capable of sliding on a track provided at the bottom of the shell such that the connection shaft and the interlocking shaft accomplish horizontal back-and-forth stretching and contracting;

an extension shaft accommodated within the shell and has an inner end thereof connected to the connection shaft;

a dildo secured to the extension shaft and is integral with the extension shaft;

a control compartment fixed at one side of the shell and having a compartment surface disposed with a power switch and a fine tuning switch; and thereby the dildo is capable of undergoing automatic mechanical movements of stretching and contracting back and forth.

2. The pleasure promotive sexual device in accordance with claim 1, wherein two sides of the shell are provided with fastening strip, respectively, for binding around the inner thighs of a person in order to prevent the device from slipping off the user.

3. The pleasure promotive sexual device in accordance with claim 1, wherein the fine tuning switch is capable of controlling the decelerating mechanism provided at one end of the motor for controlling the rotational speed of the motor axis and for further speeding up or slowing down the automatic mechanical movements of stretching and contracting back and forth provided by the extension shaft.

4. The pleasure promotive sexual device in accordance with claim 1, wherein the extension shaft is disposed with a screw opening at one end thereof, and the dildo is disposed with a screw pillar for securing into the screw opening of the extension shaft.

* * * * *